US012065905B2

(12) United States Patent
Manett et al.

(10) Patent No.: US 12,065,905 B2
(45) Date of Patent: Aug. 20, 2024

(54) VALVE ASSEMBLY

(71) Applicant: Expro North Sea Limited, Dyce (GB)

(72) Inventors: Kris Manett, Fraserburgh (GB); Linda Yeats, Portlethen (GB)

(73) Assignee: Expro North Sea Limited, Dyce (GB)

( * ) Notice: Subject to any disclaimer, the term of this patent is extended or adjusted under 35 U.S.C. 154(b) by 58 days.

(21) Appl. No.: 17/780,874

(22) PCT Filed: Nov. 20, 2020

(86) PCT No.: PCT/GB2020/052968
§ 371 (c)(1),
(2) Date: May 27, 2022

(87) PCT Pub. No.: WO2021/105652
PCT Pub. Date: Jun. 3, 2021

(65) Prior Publication Data

US 2023/0003100 A1 Jan. 5, 2023

(30) Foreign Application Priority Data

Nov. 28, 2019 (GB) ..... 1917311

(51) Int. Cl.
*E21B 34/10* (2006.01)

(52) U.S. Cl.
CPC ..... *E21B 34/10* (2013.01); *E21B 2200/04* (2020.05)

(58) Field of Classification Search
CPC ..... E21B 2200/04; E21B 34/10
See application file for complete search history.

(56) References Cited

U.S. PATENT DOCUMENTS

| | | | | |
|---|---|---|---|---|
| 5,284,209 | A | 2/1994 | Godfrey | |
| 8,662,183 | B1 | 3/2014 | Vickio, Jr. | |
| 2012/0024537 | A1* | 2/2012 | McDowell | E21B 34/12 166/373 |
| 2013/0081823 | A1 | 4/2013 | Wood | |
| 2020/0199968 | A1 | 6/2020 | Manett | |

* cited by examiner

*Primary Examiner* — Cathleen R Hutchins
*Assistant Examiner* — Ronald R Runyan
(74) *Attorney, Agent, or Firm* — Getz Balich LLC

(57) ABSTRACT

Valve assemblies are disclosed for use in the oil and gas industry. A disclosed valve assembly includes a housing having a bore; a valve member arranged within the housing which is movable relative to the bore between open and closed positions. The valve member includes a cutting feature and a sealing surface; a cutting component that cooperates with the cutting feature when the valve member is in moved to the closed position; a first seal element arranged within the housing and providing a first seal relative to the sealing surface; and a second seal element arranged within the housing and providing a second seal relative to the sealing surface. The second seal element is movable relative to the housing bore between first and second positions. A corresponding method of controlling communication along a bore of a housing is also disclosed.

19 Claims, 9 Drawing Sheets

VALVE ASSEMBLY

This application claims priority to PCT Patent Appln. No. PCT/GB2020/052968 filed Nov. 20, 2020, which claims priority GB Patent Appln. No. 1917311.1 filed Nov. 28, 2019, which are herein incorporated by reference.

BACKGROUND OF THE INVENTION

1. Technical Field

The present invention relates to a valve assembly. In particular, but not exclusively, the present invention relates to a valve assembly comprising a housing having a bore, a valve member which is movable relative to the housing bore between open and closed positions, a cutting component arranged within the housing which cooperates with a cutting feature of the valve member, and a seal element arranged within the housing which provides a seal relative to a sealing surface of the valve member. A method of controlling communication along a bore of a housing is also disclosed.

2. Background Information

In the oil and gas exploration and production industry, wellbore fluids comprising oil and/or gas are recovered to surface through a wellbore which is drilled from surface. The wellbore is lined with metal wellbore-lining tubing, which is known in the industry as casing. The casing is cemented in place within the drilled wellbore and serves numerous purposes including supporting drilled rock formations; preventing undesired ingress/egress of fluid; and providing a pathway through which further tubing and downhole tools can pass.

Numerous tubing strings and tools are run-in to the well during a procedure to complete the well in preparation for production, as well as during subsequent production of well fluids and any intervention procedures which may need to be carried out during the lifetime of the well. For example, well fluids are recovered through production tubing which is installed within the cased well, extending from the surface to the region of a producing formation. Tool strings are run-into the well, carrying downhole tools for performing particular functions within the well. Coiled tubing and wireline can be employed as an efficient method of running a downhole tool into a well.

Safety legislation requires the provision of a blow-out preventer (BOP), comprising an arrangement of shear and seal rams, which provides ultimate pressure control of the well. In an emergency situation, seal rams can seal around tubing extending through the BOP, to seal an annulus around the tubing. If required, shear rams can be activated to sever tubing and/or wireline extending through the BOP, to shut-in the well.

Other valve assemblies are provided as part of tubing strings that are run-into and located within the well. Examples include subsurface safety valves (SSSVs), which are typically installed in an upper part of the wellbore, and subsea test trees (SSTTs), which are typically installed in a lower part of the wellbore. SSSVs and SSTTs can close producing conduits in the event of an emergency.

SSSVs and SSTTs comprise an arrangement of valves which are required to perform a cutting and/or sealing function. This is to ensure safe cutting of tubing (such as coiled tubing), wireline, slickline or other wellbore components extending through the valves, and subsequent sealing of the SSSV/SSTT bore. Numerous different types of valves can be used including ball valves, gate valves and flapper valves, the latter having a purely sealing function.

Ball-type valves comprise a ball member which is rotatable between an open position in which a bore of the ball member is aligned with a bore of a housing in which the ball member is mounted, and a closed position in which the bore of the ball member is disposed transverse to the housing bore, thereby closing the valve. Gate-type valves comprise a sliding gate which is moved in a direction transverse to a bore of a housing containing the gate, to selectively open and close the housing bore.

As is well known in the industry, it is necessary to seal the housing bore following movement of the ball member (or other valve member) to a closed position. In the past, this has been achieved by deploying a valve comprising a cutting ball member having a cutting component or surface which serves for severing the tubing, wireline, slickline or other wellbore component extending through the housing bore, and a separate sealing ball member. The sealing ball member has a sealing surface or component which cooperates with a sealing surface on or in a wall of the housing, to seal the housing bore following movement of the sealing ball member to its closed position.

In more recent years, valves have been developed comprising a ball member which provides both a cutting and a sealing function, the ball member comprising both a cutting surface or component, and a sealing surface or component which cooperates with the sealing surface of the housing. Whilst this can provide efficiencies in terms of simplifying the structure of the valve and its method of operation, it has been found that it can lead to difficulties in ensuring adequate sealing of the housing bore following operation of the valve. In particular, it has been found that the cutting surface or component can have a tendency to damage the sealing surface of the housing during a closing operation. This has tended to occur particularly where components that are more bulky are to be severed, and/or where components that require the application of a larger cutting force are to be severed (such as, in both cases, coiled tubing).

Efforts have been made in the industry to address this problem. One prior valve is disclosed in European Patent Publication No. EP-2578798A1. The disclosed valve comprises a ball movable between open and closed configurations and having a cutting device arranged to shear against an anvil member when the ball is moving between the open and closed configurations, and a sealing sleeve providing a seat for seating of the ball when the ball is in the closed configuration. The sealing sleeve is moveable relative to the anvil member when the ball is moving from the open to the closed configuration, so that during opening and closing, the sealing sleeve is displaced away from the cutting device as the cutting device engages the anvil member. The sealing sleeve is pushed away from the ball and the anvil to a maximum separation (which is a small distance away from the ball) at the point on the stroke when the cutting surface of the ball is moving past the anvil member. The sealing sleeve is therefore moved out of contact with the ball when the cutting surface engages the anvil member, and moves back into contact with the ball when the cutting surface has passed the anvil member and the sealing surface of the ball is aligned with the sealing sleeve.

Movement of the sealing sleeve away from a position in which it contacts the ball is achieved by a displacement mechanism comprising a cam device having a non-circular profile, which pushes the sealing sleeve away from the ball. This increases the complexity of the valve, with an associated impact on manufacturing and maintenance costs. It also makes the valve more bulky, in comparison to prior valves which do not include such a displacement mechanism. This can be problematic as space is often restricted, as would be the case, for example, in an SSSV or SSTT located in a marine riser. Further, the mechanical arrangement by which the sealing sleeve is moved away from the ball provides only a small movement of the sealing sleeve away from the ball, with the possibility of the sealing sleeve coming into contact with part of a downhole component that has been deployed through the valve and severed during closing of the ball. The mechanical arrangement could also create difficulties in the event that the sealing sleeve becomes jammed within a housing for the ball, for example through contact with part of a downhole component that has been severed, or by the presence of debris. In an extreme situation, this could hamper movement of the ball towards its closed position, since the cam device is mounted to the ball and contacts the sealing sleeve to move it away from the position in which it contacts the ball. Jamming of the sealing sleeve could therefore restrict movement of the ball, and so closing of the valve. In addition, the requirement for the cam device to urge the sealing sleeve away from the ball has the result that a greater force is required to move the ball between its different positions than would otherwise be the case.

SUMMARY OF THE INVENTION

According to a first aspect of the present disclosure, there is provided a valve assembly comprising: a housing having a bore; a valve member arranged within the housing, the valve member being movable relative to the housing bore between an open position in which communication along the bore is permitted, and a closed position in which communication along the bore is restricted, the valve member comprising a cutting feature and a sealing surface; a cutting component arranged within the housing, the cutting component cooperating with the cutting feature of the valve member when the valve member is moved to the closed position; a first seal element arranged within the housing, the first seal element providing a first seal relative to the sealing surface of the valve member, to seal the valve member relative to the housing; and a second seal element arranged within the housing, the second seal element providing a second seal relative to the sealing surface of the valve member, to seal the valve member relative to the housing, the second seal element being movable relative to the housing bore between a first position in which it is out of sealing contact with the sealing surface of the valve member and a second position in which it is in sealing contact with the sealing surface of the valve member.

The provision of a valve assembly comprising such first and second seal elements may provide an enhanced sealing effect on the valve member, in comparison to a valve assembly comprising only a single seal element. It may also or alternatively provide a backup for the event that the first seal element becomes damaged, for example through contact with the cutting feature of the valve member, when the valve member is moved to the closed position, and/or through contact with part of a body (e.g. a downhole component) that has been deployed through the valve and severed during closing of the valve member. The second seal that is provided by the second seal element may be on or with the same valve member as the first seal, and may be with the same sealing surface of the valve member.

According to a second aspect of the present disclosure, there is provided a valve assembly comprising: a housing having a bore; a valve member arranged within the housing, the valve member being movable relative to the housing bore between an open position in which communication along the bore is permitted, and a closed position in which communication along the bore is restricted, the valve member comprising a cutting feature and a sealing surface; a cutting component arranged within the housing, the cutting component cooperating with the cutting feature of the valve member when the valve member is moved to the closed position; and a seal element arranged within the housing, the seal element providing a seal relative to the sealing surface of the valve member, to seal the valve member relative to the housing, the seal element being movable relative to the housing bore between a first position in which it is out of sealing contact with the sealing surface of the valve member and a second position in which it is in sealing contact with the sealing surface of the valve member, the seal element being movable between the first and second positions by the application of fluid pressure.

The provision of a valve assembly comprising a seal element which is movable between such first and second positions on the application of fluid pressure may provide the advantage that movement of the seal element between its different positions is separate from (in particularly mechanically separated from) movement of the valve member between its open and closed positions. This may have the effect that the valve member itself is not required to impart a force (in particular a mechanical force) on the seal element to move it between different positions. Movement of the seal element between its different positions by applied fluid pressure may also help to avoid problems that might occur if the seal element should become jammed, as a relatively high pressure force may be able to be applied to the seal element to release it, without requiring that force to be transmitted through the valve member to the seal element. A hydraulic lock may also exist which serves to maintain the seal element in its second position (in sealing contact with the sealing surface of the valve member), when the valve member is in its closed position, and optionally in its first position (out of sealing contact with the sealing surface of the valve member).

In the valve assembly of the first aspect of the present disclosure, the seal element may be movable between the first and second positions by the application of fluid pressure.

In the valve assembly of the second aspect of the present disclosure, the seal element may be a second seal element, and the valve assembly may comprise a first seal element as defined in the first aspect.

According to a third aspect of the present disclosure, there is provided a valve assembly comprising: a housing having a bore; a valve member arranged within the housing, the valve member being movable relative to the housing bore between an open position in which communication along the bore is permitted, and a closed position in which communication along the bore is restricted, the valve member comprising a cutting feature and a sealing surface; a cutting component arranged within the housing, the cutting component cooperating with the cutting feature of the valve member when the valve member is moved to the closed position; a first seal element arranged within the housing, the first seal element providing a first seal relative to the sealing surface of the valve member, to seal the valve member relative to the housing; and a second seal element arranged within the housing, the second seal element providing a second seal relative to the sealing surface of the valve member, to seal the valve member relative to the housing, the second seal element being movable relative to the housing bore between a first position in which it is out of sealing contact with the sealing surface of the valve member and a second position in which it is in sealing contact with the sealing surface of the valve member, the second seal element being movable between the first and second positions by the application of fluid pressure.

The valve assembly of the third aspect may effectively be considered to be a combination of features of the valve assemblies of the first and second aspects. The advantages discussed above in relation to the first and second aspects may therefore be found in the valve assembly of the third aspect.

Optional further features of the valve assemblies of any one of the first to third aspects may be derived from the following text. In the context of the valve assembly of the second aspect, references below to further features of the second seal element may be taken as applying in a corresponding fashion to the seal element of the second aspect.

The second seal element of the first and/or third aspects, and the seal element of the second aspect, may be movable between its positions by the application of fluid pressure on the seal element.

The second seal element may be hydraulically actuated for movement between its first and second positions. The second seal element may be or may comprise a piston. The housing may define at least part of a cylinder within which the piston is mounted. The piston may be movable within the cylinder between first and second positions, which may correspond to the first and second positions of the second seal element. The piston may comprise opposed first and second piston faces. Application of fluid pressure to the first piston face may move the second seal element in a first direction relative to the housing bore. Application of fluid pressure to the second piston face may move the second seal element in a second direction relative to the housing bore. The second direction may be opposite to the first direction. One of the first and second directions may be towards the valve member, and the other one of the first and second directions may be away from the valve member.

The valve assembly may be arranged so that movement of the second seal element from its first position to its second position is only triggered following commencement of movement of the valve member towards its closed position. The valve assembly may be arranged so that movement of the second seal element from its first position to its second position is only triggered following movement of the valve member to a position in which the second seal element is shielded from contact with the cutting feature of the valve member, and/or cannot contact the cutting feature. In said position of the valve member, the valve member itself, for example the sealing surface, may shield the second seal element from contacting the cutting feature. The valve assembly may be arranged so that movement of the second seal element from its first position to its second position is only triggered following movement of the valve member to a position in which its cutting feature is proximate the cutting component. The cutting feature and the cutting component may cooperate to cut a body extending through the housing bore in an overlapping scissors-type cutting or shearing action. The valve assembly may be arranged so that movement of the second seal element from its first position to its second position is only triggered following movement of the valve member to a position in which the cutting feature overlaps the cutting component. The valve assembly may be arranged so that movement of the second seal element from its first position to its second position is only triggered following location of the valve member in its closed position. This may require completion of a movement of the valve member to its closed position before movement of the second seal element is triggered.

The valve assembly may be arranged so that the valve member is moved from its closed position towards its open position when the second seal element is moved from its second position towards its first position. The valve assembly may be arranged so that movement of the valve member from its closed position towards its open position is only triggered following movement of the second seal element away from its first position, optionally following movement of the second seal element to a position in which it is out of sealing contact with the valve member. The valve assembly may be arranged so that movement of the valve member from its closed position to its open position is only triggered after the second seal element has moved a majority of a distance from its second position towards its first position, optionally in which the second seal element is proximate an end of its travel to the first position. The valve assembly may be arranged so that movement of the valve member from its closed position to its open position is only triggered following location of the second seal element in its first position. This may require completion of a movement of the second seal element to its first position before movement of the valve member is triggered.

The arrangements for the valve assembly specified in the preceding paragraphs may provide the advantage that contact between the second seal element and the valve member is avoided during movement of the valve member between its open and closed positions. This may help to avoid contact between the cutting feature of the valve member and the second seal element, as the valve member moves between its positions. This may reduce a likelihood of damage to the sealing surface of the valve member, and/or a sealing surface of the second seal element, during movement of the valve member between its positions.

The valve assembly may comprise a control assembly for controlling at least one of: a) movement of the valve member between its open and closed positions; and b) movement of the second seal element between its first and second positions. The control assembly may be arranged to control both such movements. Optionally, the control assembly is arranged or configured to sequence the movements of the valve member and the second seal element as set out in the preceding paragraphs.

The control assembly may be a hydraulic control assembly. The valve assembly may be adapted to be coupled to a source of fluid, suitably hydraulic fluid, to provide motive power for movement of the valve member and/or the second seal element. The valve assembly may comprise at least one fluid line for communicating with the source of fluid, and may comprise a fluid supply line and a fluid return line.

The valve member may be moveable between the open and closed positions by the application of fluid pressure. The control assembly may be arranged to control the supply of fluid to and from a piston associated with the valve member, movement of the piston causing the valve member to move between its open and closed positions. The control assembly may be arranged to control the supply of fluid to and from the second seal element, to move it between its open and closed positions. The control assembly may be arranged or configured so that it is operated to supply fluid to the valve member, to move it from its open position towards its closed position, and then to supply fluid to the second seal element to move it from its first position towards its second position. The control assembly may be arranged or configured so that it only supplies fluid to the second seal element, to move it towards its second position, when the valve member has commenced its movement towards the closed position. The control assembly may be arranged or configured so that it supplies fluid to the second seal element, to commence its movement from the second position to the first position, and only then supplies fluid to the valve member to move it from the closed position towards the open position. The control assembly may be arranged or configured so that it only supplies fluid to the valve member, to move it to its open position, when the second seal element has commenced its movement to the first position. The control assembly may be arranged to control the supply of fluid to and from the valve member piston, and the second seal element, according to the sequence of operation defined in the preceding paragraphs.

The control assembly may comprise a seal control valve for controlling the supply of fluid to the second seal element, to move it from its first position to its second position. The control valve may be associated with or provided by the valve member piston. The control valve may comprise a flow passage having a flow port which can communicate with an inlet port of a communication passage associated with the second seal element, when the piston is operated to move the valve member towards its closed position. The valve member piston may comprise a seal which is arranged to isolate the flow port from the inlet port of the communication passage. Movement of the valve member piston towards a position in which the valve member is in its closed position may cause fluid communication between the flow port and the inlet port of the communication passage to be opened.

The control assembly may comprise a valve member control valve for controlling the supply of fluid to the valve member, suitably the valve member piston, to move it from the closed position to the open position. The control valve may be or may comprise a valve element, such as a poppet, which is biased towards a closed position in which fluid flow to the valve member, to move it to its open position, is prevented. The control valve element may be adapted to cooperate with the second seal element to move to an open position in which fluid flow to the valve member, to move it to its open position, is permitted. The control valve element may be contacted by the second seal element (or a component coupled to the second seal element) when it is moved to its first position, which may move the control valve element from its closed position to its open position.

The control assembly may comprise an actuator for controlling at least one of the movements a) and b) set out above. The actuator may be associated with or may define one or more control valves for controlling at least one of said movements, and may be operable to open and close said control valve(s). The actuator may be operable to cause at least one of said movements on receipt of a control signal. Receipt of a control signal by the actuator may cause the actuator to open a fluid communication path and/or to supply fluid to the selected one or more of the valve member and the second seal element (suitably by controlling said valve or valves), to cause the desired movement. The actuator may be an electro-mechanical actuator such as a solenoid. The control signal may then be an electrical control signal. The actuator may be a pressure switch, such as a roller or plunger type pressure switch. The control signal may then be a pressure signal. The control signal may be issued from surface to the valve assembly, for example via a control line (electrical or hydraulic); via a fluid pressure signal, acoustic signal, radio or other frequency signal, which may be transmitted through a column of fluid in tubing or a wellbore in which the valve assembly is deployed, or through tubing coupled to the valve assembly, as appropriate. The valve assembly may comprise a controller associated with the control assembly, which may receive the control signal and issue a command signal to the actuator to operate the actuator.

The valve member may be a ball member or ball type member. The ball member may be rotatable between the open and closed positions. It will be understood however that the valve member may be any other suitable type of valve member, including but not restricted to a sliding gate and rotatable flapper plate.

In the open position of the valve member, the housing bore may not be restricted by the valve member. In the open position of the valve member, fluid communication along the bore may be permitted. In the closed position of the valve member, the housing bore may be completely closed by the valve member, and so communication along the bore may be prevented. In the closed position of the valve member, fluid communication along the bore may be restricted, and optionally may be prevented. The reference to communication along the bore should be taken to encompass the passage of bodies along the housing bore, such bodies including but not restricted to wireline, slickline, coiled tubing and other tubing, downhole tools and parts thereof including tubing forming a tool string.

The cutting component and the first seal element may be provided together, for example on a body that is mountable within or provided as part of the housing.

The valve assembly may be for use in an oil and/or gas well, and may be for controlling the flow of fluid into and/or out of the well. The valve assembly may be for controlling the passage of bodies, of the type described above, into and out of the well.

When the valve member is in its closed position, both of the first and second seal elements may be in sealing contact with the sealing surface of the valve member. The first seal element may be in sealing contact with the sealing surface of the valve member in both its open position and its closed position. When the valve member is in its closed position, the second seal element may be in its second position, in sealing contact with the sealing surface of the valve member.

The first seal element may be secured against movement relative to the housing.

The first seal element and the second seal element may be arranged so that sealing forces imparted on the valve member by the seal elements are directed in common axial directions, which may be taken in a direction relative to the housing.

The second seal may be a metal-to-metal seal, which may be provided between the sealing surface of the valve member and the second seal element.

The first seal element may provide a first seal relative to the sealing surface of the valve member at least when the valve member is in its closed position, and optionally also when the valve member is in its open position. The first seal element may be mounted within the housing, and may be biased or urged into sealing engagement with the valve member, such as by a compression spring (e.g., a disc spring such as a Belleville washer or spring). The first seal element may be provided on or as part of a body which is mounted within the housing. The first seal element may comprise a sealing surface adapted to cooperate with the sealing surface of the valve member to provide the first seal.

The cutting component may cooperate with the cutting feature of the valve member when the valve member is moved to the closed position to cut a body extending along the bore of the housing.

The second seal element may be disposed inwardly, optionally radially inwardly, of the first seal element. Alternatively, the second seal element may be disposed outwardly, optionally radially outwardly, of the first seal element. The second seal element may be mounted within the housing for translational movement relative to the housing bore, in a direction along a length of the bore. The second seal element may be generally annular. The second seal element may be generally tubular, and may take the form of a sleeve. The second seal element may comprise a sealing surface adapted to cooperate with the sealing surface of the valve member to provide the second seal. The sealing surface may be provided on, near or adjacent an end of the second seal element, optionally an end which faces towards the valve member.

The valve member may comprise a valve bore which permits communication along the housing bore when the valve member is in the open position. In the open position of the valve member, the bore of the valve member may be substantially aligned with the housing bore. The valve member bore may describe a minimum internal dimension, which may be a diameter (for example where the bore is circular in cross-section). The second seal element may comprise a bore, which may be substantially aligned with the housing bore. The second seal element bore may describe a minimum internal dimension, which may be a diameter (for example where the bore is circular in cross-section). The minimum internal dimension described by the second seal element bore may be substantially the same as, or optionally greater than, the minimum internal dimension described by the valve member bore. This may provide the advantage of reducing a likelihood of an end of the second seal element, which may comprise or define a sealing surface, contacting a body being passed through the housing bore.

According to a fourth aspect of the present disclosure, there is provided a method of controlling communication along a bore of a housing, the method comprising the steps of: locating a valve member within the housing, the valve member comprising a cutting feature and a sealing surface; arranging the valve member so that it is movable relative to the housing bore between an open position in which communication along the bore is permitted, and a closed position in which communication along the bore is restricted; locating a cutting component within the housing; operating the valve member to move to its closed position, movement of the valve member to the closed position facilitating cooperation between the cutting component and the cutting feature of the valve member; locating a first seal element within the housing, and arranging the first seal element so that it provides a first seal relative to the sealing surface of the valve member, to seal the valve member relative to the housing; locating a second seal element within the housing, and arranging the second seal element so that it provides a second seal relative to the sealing surface of the valve member; and moving the second seal element relative to the housing bore between a first position in which it is out of sealing contact with the sealing surface of the valve member, and a second position in which it is in sealing contact with the sealing surface of the valve member, when the valve member is in its closed position, to seal the valve member relative to the housing.

Optionally, the seal element is moved between the first and second positions by the application of fluid pressure.

According to a fifth aspect of the present disclosure, there is provided a method of controlling communication along a bore of a housing, the method comprising the steps of: locating a valve member within the housing, the valve member comprising a cutting feature and a sealing surface; arranging the valve member so that it is movable relative to the housing bore between an open position in which communication along the bore is permitted, and a closed position in which communication along the bore is restricted; locating a cutting component within the housing; operating the valve member to move to its closed position, movement of the valve member to the closed position facilitating cooperation between the cutting component and the cutting feature of the valve member; locating a seal element within the housing, and arranging the seal element so that it provides a seal relative to the sealing surface of the valve member; and moving the seal element relative to the housing bore between a first position in which it is out of sealing contact with the sealing surface of the valve member, and a second position in which it is in sealing contact with the sealing surface of the valve member, when the valve member is in its closed position, to seal the valve member relative to the housing, the seal element being moved between the first and second positions by the application of fluid pressure.

Further features of the methods of the fourth and/or fifth aspects may be derived from the text set out elsewhere in this document, including in or with reference to any one of the first to third aspects set out above.

The method(s) may be for controlling communication within an oil and/or gas well, and may be for controlling the flow of fluid into and/or out of the well. The housing may communicate with or form part of wellbore tubing. The method(s) may involve controlling the passage of bodies, of the type described above, into and/or out of the well.

In further aspects of the present disclosure, there may be provided a flow control assembly comprising the valve assembly of any one of the first to third aspects. The flow control assembly may be for use in controlling the flow of fluid in an oil and/or gas well, and may be or form part of a BOP, an SSST, an SSSV or any other type of valve that can be employed in the oil and gas exploration and production industry.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
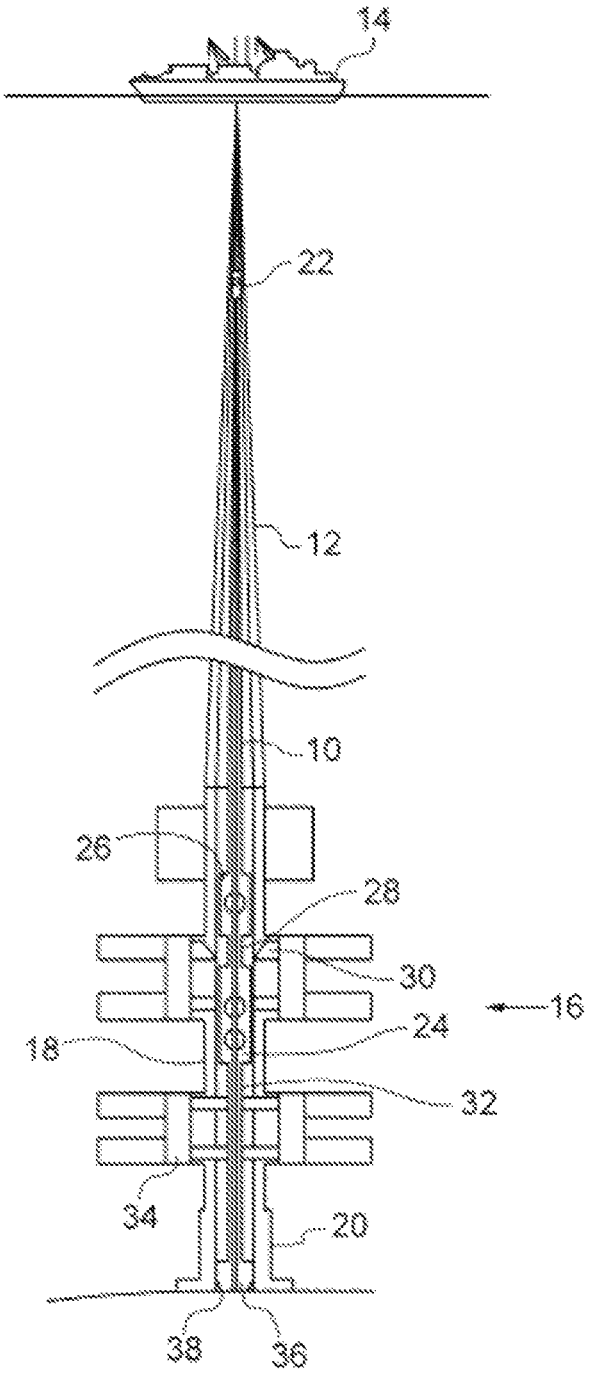
FIG. 1 (Prior Art)
FIG. 1 is a schematic view of a prior landing string assembly, shown in use within a riser and extending between a surface vessel and a subsea wellhead assembly which includes a BOP mounted on a wellhead.

Turning firstly to FIG. 1, there is shown a schematic view of a landing string assembly 10, shown in use within a riser 12 and extending between a surface vessel 14 and a subsea wellhead assembly 16 which includes a BOP 18 mounted on a wellhead 20. The use and functionality of landing strings are well known in the industry for through-riser deployment of equipment, such as completion architecture, well testing equipment, intervention tools and the like into a subsea well from a surface vessel.

When in a deployed configuration the landing string 10 extends through the riser 12 and into the BOP 18. While deployed the landing string 10 provides many functions, including permitting the safe deployment of wireline or coiled tubing equipment (not shown) through the landing string and into the well, providing the necessary primary well control barriers and permitting emergency disconnect while isolating both the well and landing string 10. Wireline or coiled tubing deployment may be facilitated via a lubricator valve 22 which is located proximate the surface vessel 14.

Well control and isolation in the event of an emergency disconnect is provided by a suite of valves, which are located at a lower end of the landing string 10 inside the BOP. The valve suite includes a lower valve assembly called the subsea test tree valve (SSTT valve or SSTT) 24 which provides a safety barrier to contain well pressure, and also functions to cut any wireline or coiled tubing (or other body) which extends through the landing string 10. The valve suite also includes an upper valve assembly, typically referred to as a retainer valve 26, which isolates the landing string contents and which can be used to vent trapped pressure from between the retainer valve 26 and SSTT valve 24. A shear sub component 28 extends between the retainer valve 26 and SSTT valve 24, which is capable of being sheared by shear rams 30 of the BOP 18 if required. A slick joint 32 extends below the SSTT valve 24 which facilitates engagement with BOP pipe (seal) rams 34.

The landing string 10 may include an interface arrangement for interfacing with other oilfield equipment. For example, the landing string 10 can include a tubing hanger 36 at its lowermost end, which engages with a corresponding tubing hanger 38 provided in the wellhead 20. When the landing string 10 is fully deployed and the corresponding tubing hangers 36 and 38 are engaged, the weight of a lower string (such as a completion, workover string or the like which extends into the well and thus is not illustrated) becomes supported through the wellhead 20.

Figure 2:
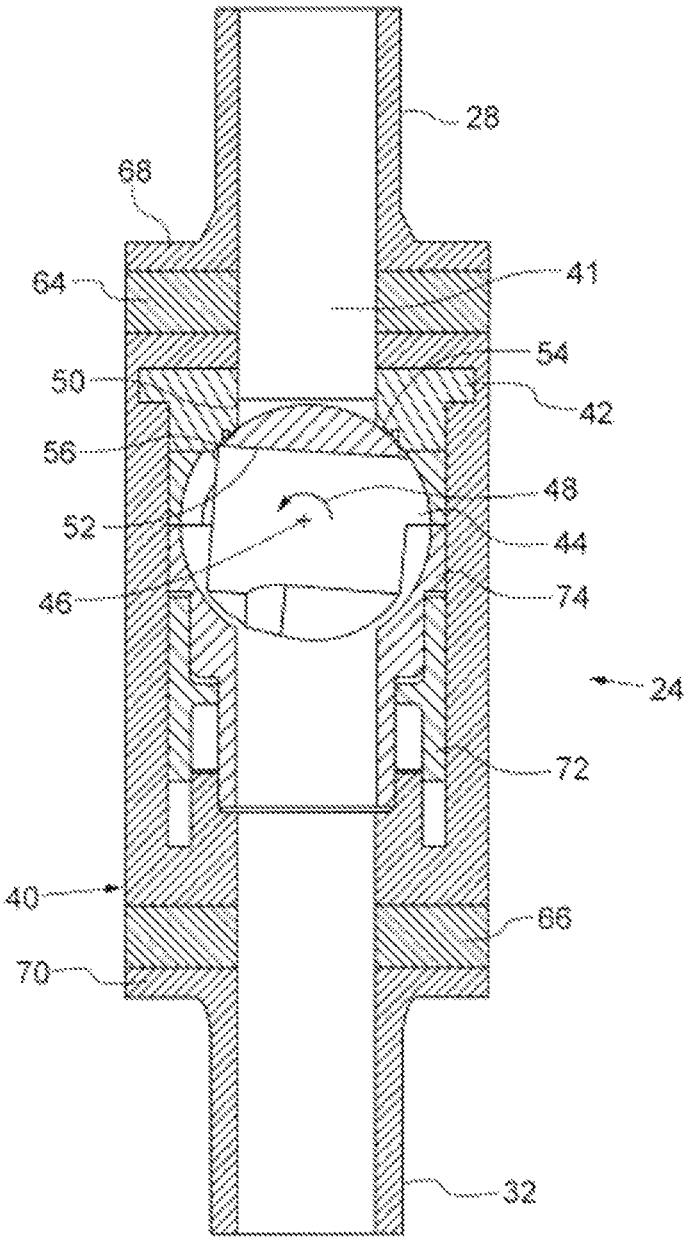
FIG. 2 (Prior Art)
FIG. 2 is a longitudinal cross-sectional view of a known type of valve assembly, which can perform various functions, and which can form part of an SSTT valve of the landing string shown in FIG. 1.

Referring now to FIG. 2, there is shown a longitudinal cross-sectional view of a known type of valve, which can perform various functions, and which can form part of the SSTT valve 24 of the landing string 10 shown in FIG. 1. It should be noted that although the SSTT valve 24 shown in FIG. 1 is a dual valve assembly, FIG. 2 shows only a single valve, for ease of illustration. The SSTT valve 24 is of the type disclosed in the applicant's International Patent Publication No. WO-2016/113525, the disclosure of which is incorporated herein by way of reference, and which takes the general form of a ball-type valve.

The ball valve 24 shown in FIG. 2 includes a housing, generally identified by reference numeral 40, which is secured between the upper shear sub component 28 and the lower slick joint 32. As such, the ball valve 24 is installed in-line with the landing string 10, which can be considered to be a fluid conduit system. The housing 40 has a bore 41 and accommodates a ball seat 42 and a ball-type valve member 44, the ball member 44 being rotatable about axis 46 to selectively close the ball valve 24 and control flow through the landing string 10. The illustrated ball member 44 is rotatable in the direction of arrow 48 to close the ball valve 24. The ball seat 42 and ball member 44 define respective throughbores 50 and 52. When aligned, the throughbores 50 and 52 define a flow path through the valve 24. When misaligned (as shown in FIG. 2), the throughbores 50 and 52 prevent or restrict flow through the valve. When the ball member 44 is closed, a sealing area 54 is defined between the ball seat 42 and the ball member 44.

The ball member 44 is rotatable between an open position in which the throughbores 50 and 52 are aligned, and a closed position (shown in FIG. 2) in which the ball bore 52 is disposed transverse to the seat bore 50, so that the throughbores are misaligned. In the closed position, flow through the valve 24, and the passage of equipment through the valve and into the wellbore, is prevented. As described in detail in WO-2016/113525, a leading edge surface 56 of the ball member 44 is configured to cut through a body (not shown in FIG. 2), such as wireline, coiled tubing or the like which extends through the valve 24 and landing string 10, upon closure of the ball member 44.

The housing 40 is configured to be mechanically secured in-line with the landing string 10 (FIG. 1). The housing 40 comprises a generally cylindrical member which extends between axially opposing end flange connectors 64 and 66, which are secured to flange components 68 and 70 of the shear sub 28 and slick joint 32, respectively. The housing 40 is designed to accommodate mechanical forces, such as axial and bending forces, associated with the landing string 10 and those of any supported lower string. The housing 40 also provides pressure containment of any and all internal and/or external pressures.

The ball valve further includes an actuator assembly, generally identified by reference numeral 72, for use in actuating the ball member 44 to rotate it relative to the ball seat 42 between its open and closed positions. The actuator assembly drives a cage 74 coupled to the ball member 44, which is translated axially to rotate the ball member between its open and closed positions, via trunnions (not shown in this drawing) mounted on the ball member. In the present example, the actuator assembly 72 comprises a piston arrangement, however it should be understood that other actuators may be used.

Figure 3:
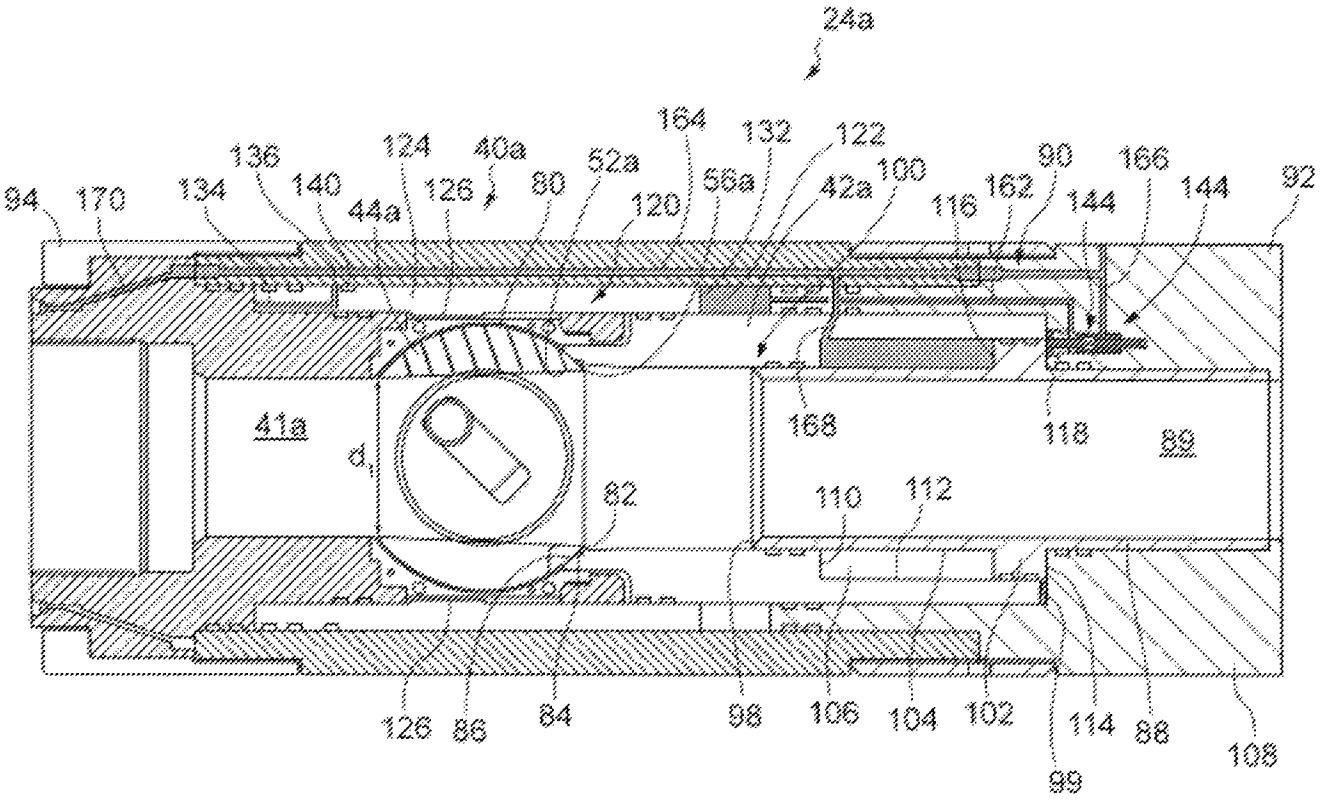
FIG. 3 is a longitudinal sectional view of a valve assembly according to an embodiment of the present invention, which may have a similar function to the valve assembly shown in FIG. 2, the drawing showing a valve member of the assembly in an open position, and a seal element of the assembly in a first position out of sealing contact with the valve member.

Turning now to FIG. 3, there is shown a longitudinal sectional view of a valve assembly according to an embodiment of the present invention, which may have a similar function to the valve assembly shown in FIG. 2 and described above. However, the valve assembly of the present invention may have a use in relation to other types of valve assembly beyond those discussed above and shown in FIG. 2. The valve assembly may have a use in industries other than the oil and gas exploration and production industry. In general terms, the valve assembly of the invention may have a use generally in any situation in which communication along a tubular component (in particular the control of flow of a fluid through a tubular component) is required, and/or where there is a requirement to sever a body disposed within a bore of a tubular component.

The valve assembly is indicated in FIG. 3 by reference numeral 24*a*. Like components of the valve assembly 24*a* with the valve assembly 24 shown in FIGS. 1 and 2 share the same reference numerals, with the addition of the suffix 'a'.

Figure 4:
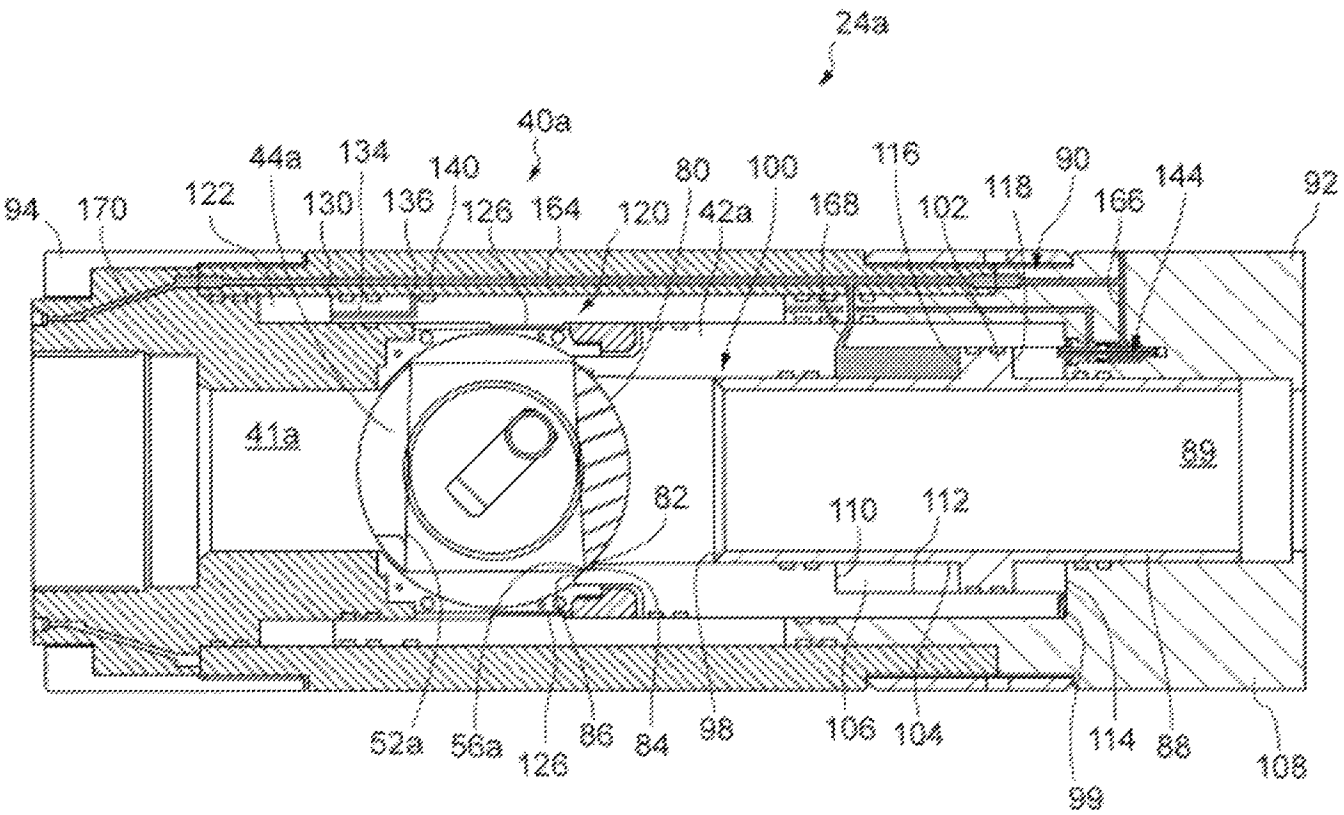
FIG. 4 is a view of the valve assembly of FIG. 3 showing the valve member in a closed position.
Figure 5:
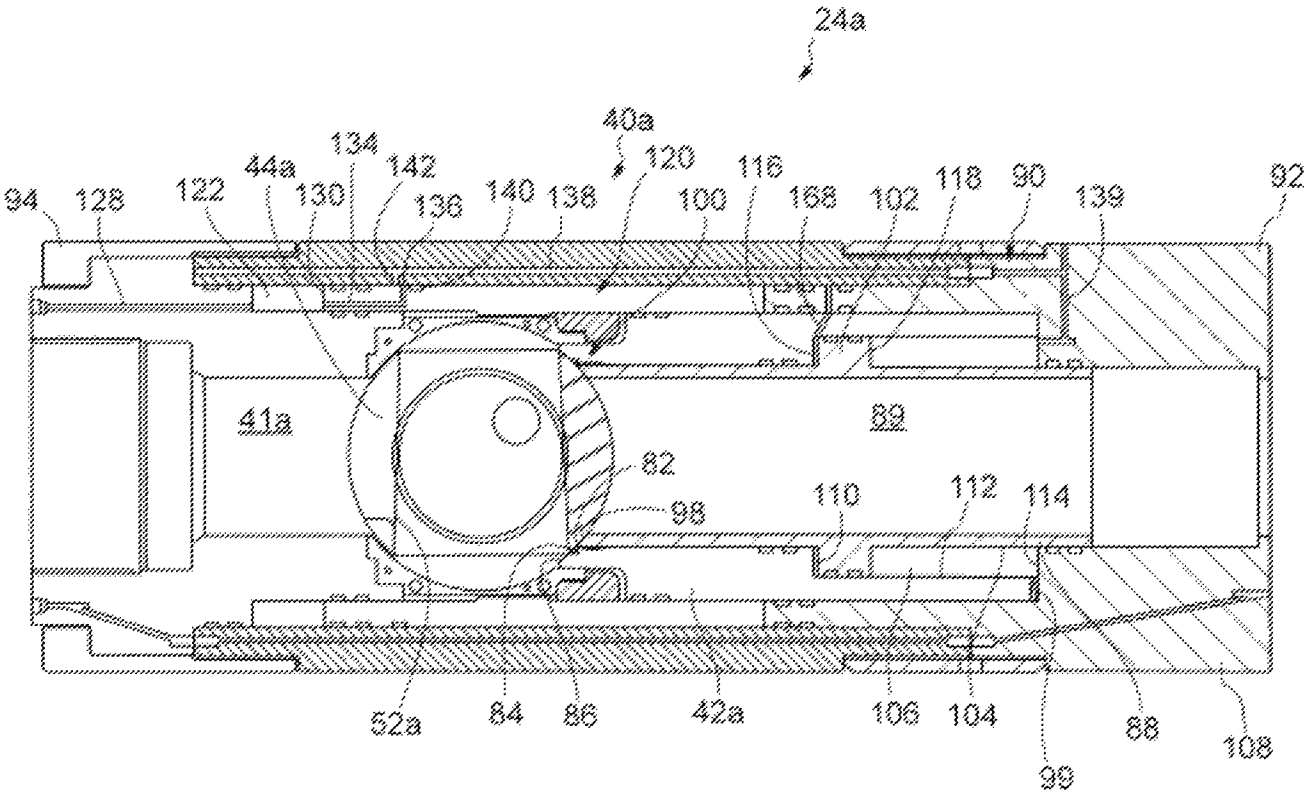
FIG. 5 is a view of the valve assembly of FIG. 3, showing the valve member in the closed position of FIG. 4, and the seal element in a second position in sealing contact with the valve member.

The valve assembly 24*a* generally comprises a housing 40*a* having a bore 41*a*, and a valve member in the form of a ball-type member 44*a*, arranged within the housing. The valve member 44*a* is moveable relative to the housing bore 41*a* between an open position which is shown in FIG. 3, and a closed position which is shown in FIGS. 4 and 5. In the open position of the valve member 44*a*, communication along the housing bore 41*a* is permitted, whilst in the closed position, communication along the bore 41*a* is restricted. The valve member 44*a* comprises a cutting feature, which takes the form of a hardened cutting edge surface 56*a*, and a sealing surface 80, which is provided by a generally spherical outer surface of the valve member 44*a*.

The valve assembly 24*a* also comprises a cutting component 42*a*, which is provided by a valve seat, the cutting component arranged within the housing 40*a*. The cutting component 42*a* cooperates with the cutting feature 56*a* of the valve member 44*a*, and can cut any body that might reside within the bore 41*a* of the housing 40*a* when the valve member is moved to the closed position. As will be understood by persons skilled in the art, the body may comprise any suitable element that can be deployed into the wellbore of an oil or gas well, including but not restricted to wireline, slickline, tubing such as coiled tubing or tool strings, downhole tools and parts thereof. In the illustrated embodiment, the cutting component comprises a hardened cutting surface 82 provided on the seat 42*a*, and which may suitably take the form of a cutting rim, or cutting teeth, extending at least partway around a circumference of the seat 42*a*.

The valve assembly 24*a* also comprises a first seal element 84 arranged within the housing 40*a*, the first seal element providing a first seal relative to the sealing surface 80 of the valve member 44*a*, to seal the valve member relative to the housing 40*a*. The first seal element suitably takes the form of a generally annular seal located in a face 86 defined by an end of the seat 42*a*, and which may be of a suitable sealing material. Elastomeric materials may be suitable for forming the seal element 84, although a metal-to-metal seal may be preferred, for example by a suitably selected metal or metal alloy material which may be of a softer material than that forming a remainder of the seat 42*a*. It will also be understood that a curved face 86 of the seat 42*a* may form at least part of the first seal element, for example providing a metal-to-metal seal with the sealing surface 80 of the valve member 44*a*.

The valve assembly 24*a* also comprises a second seal element arranged within the housing 40*a*, the second seal element indicated generally by reference numeral 88. The second seal element 88 provides a second seal relative to the sealing surface 80 of the valve member 44*a*, to seal the valve member relative to the housing 40*a*. The second seal element 88 is moveable relative to the housing bore 41*a* between a first position in which it is out of sealing contact with the sealing surface 80 of the valve member 44*a* (FIG. 3), and a second position in which it is in sealing contact with the sealing surface 80 of the valve member 44*a* (FIG. 5).

The valve assembly 24*a* is operated to sever, shear and/or cut a body extending along the bore 41*a* of the housing 40*a*, and to seal the housing bore, in a similar fashion to the prior valve assembly 24 shown in FIGS. 1 and 2 and discussed above. This is achieved by operating the ball valve member 44*a* to rotate between its open position shown in FIG. 3 and its closed position shown in FIGS. 4 and 5. As will be understood, such movement of the valve member 44*a* acts to sever any body that might reside in the housing bore 41*a* at that time, and to seal the housing bore by contact between the first seal element 84 and the sealing surface 80 of the valve member 44*a*. This provides the first seal described above.

In addition however, the present invention can provide a second seal, which potentially provides numerous advantages. These include that the first and second seal elements 84 and 88 provide an enhanced sealing effect on the valve member 44*a*, in comparison to a valve assembly comprising only a single seal element, such as the valve assembly 24 shown in FIG. 2. It may provide a backup for the event that the first seal element 84 becomes damaged, for example through contact with the cutting edge surface 56*a* of the valve member 44*a* (during rotation towards its closed position), and/or through contact with part of a body that has been deployed through the valve and severed during closure of the valve member 44*a*. It can also provide the advantage that the second seal element 88 can be located in a position in which it is out of sealing contact with the valve member 44*a* when a cutting operation is performed, to reduce a risk of damage to a sealing surface of the second seal element, for example by contact with the cutting edge surface 56*a* of the valve member 44*a* and/or a body residing in the housing bore 41*a* during cutting.

In the illustrated embodiment, the second seal element 88 is moveable between its first position shown in FIG. 3, and its second position shown in FIG. 5, by the application of fluid pressure. This may provide the advantage that movement of the second seal element 88 between its different positions is separate from (and in particular mechanically separated from) movement of the valve member 44*a* between its open and closed positions. This has the effect that the valve member 44*a* may not itself be required to impart a force (in particular a mechanical force) on the second seal element 88 to move it between its different positions. Movement of the second seal element 88 between its different positions by applied fluid pressure may also help to avoid problems that might occur if the seal element should become jammed, as a relatively high pressure force can be applied to the seal element to release it, without requiring that a high (mechanical) force be transmitted through the valve member 44*a* on to the seal element 88.

Whilst the present invention is primarily described in this document as comprising first and second seal elements 84 and 88, embodiments of the invention may comprise only the movable, pressure activated seal element 88.

Figure 7:
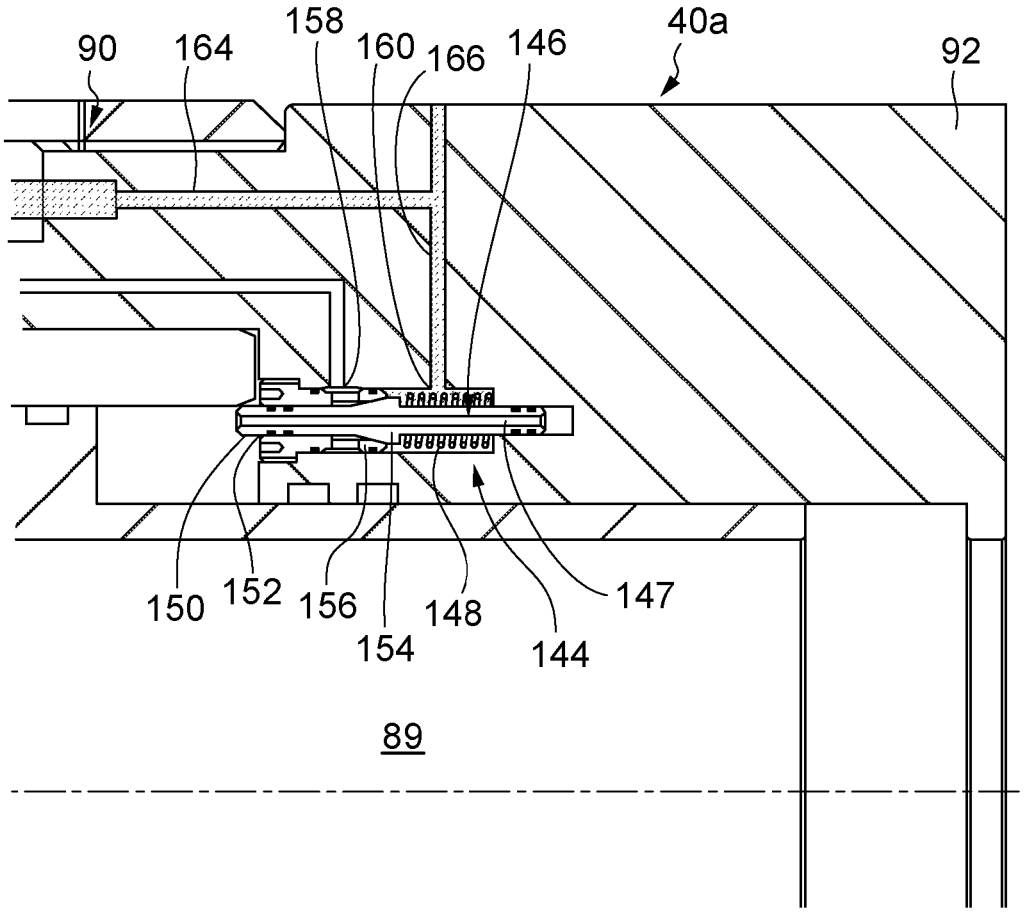
FIGS. 7 and 8 are enlarged views of part of a control assembly of the valve assembly shown in FIG. 3, illustrating a control valve of the control assembly in closed and open positions, respectively.
Figure 8:
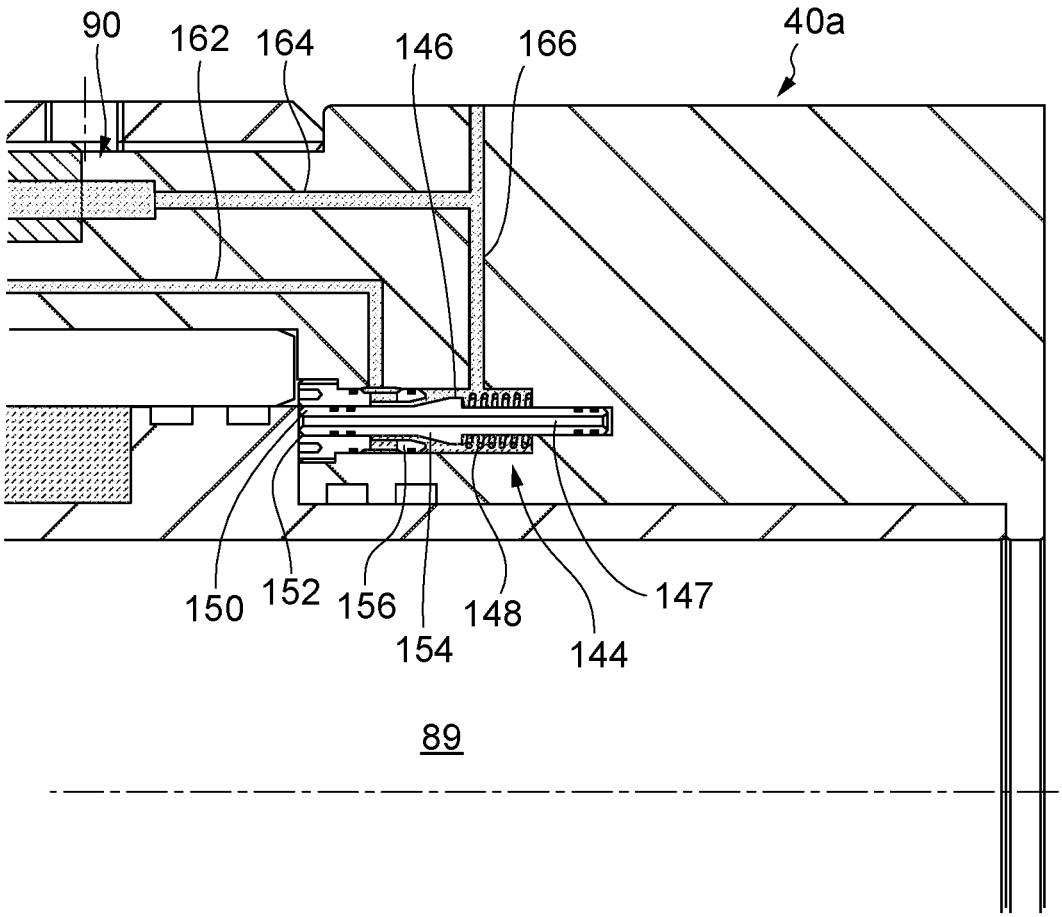

The invention will now be described in more detail, with reference also to FIG. 6, which is a view corresponding to FIG. 3 but showing the valve member 44*a* during movement from its open position to its closed position. Reference will also be made to FIGS. 7 and 8, which are enlarged views of part of the valve assembly 24*a* shown in the positions of FIGS. 3 and 4 respectively, and which illustrate part of a control assembly 90 for controlling movement of the second seal element 88 and the valve member 44*a*.

The valve assembly 24*a*, when being used to provide a sealing function of the type described above in relation to FIGS. 1 and 2, will typically be arranged so that a first end 92 of its housing 40*a* is an uphole end (for example connected to the shear subcomponent 28), and so that a second end 94 is a downhole end (for example connected to the slick joint 32). This may be preferred as any part of a body extending through the valve member 44*a*, and which is sheared when it is moved to its closed position, will then fall out of the valve member and into the well under gravity. In addition, and as can be appreciated particularly from FIG. 3, a body such as coiled tubing that is run into the bore 41*a* of the valve assembly 24*a* cannot come into contact with an end of the seal element 88 which faces towards the valve member 44*a*. It will be understood however that the valve assembly 24*a* may function equally well with its housing 40*a* oriented in the opposite fashion, and that indeed location in either orientation may be appropriate in different circumstances other than as use in a valve of the type shown in FIG. 2.

Figure 9:
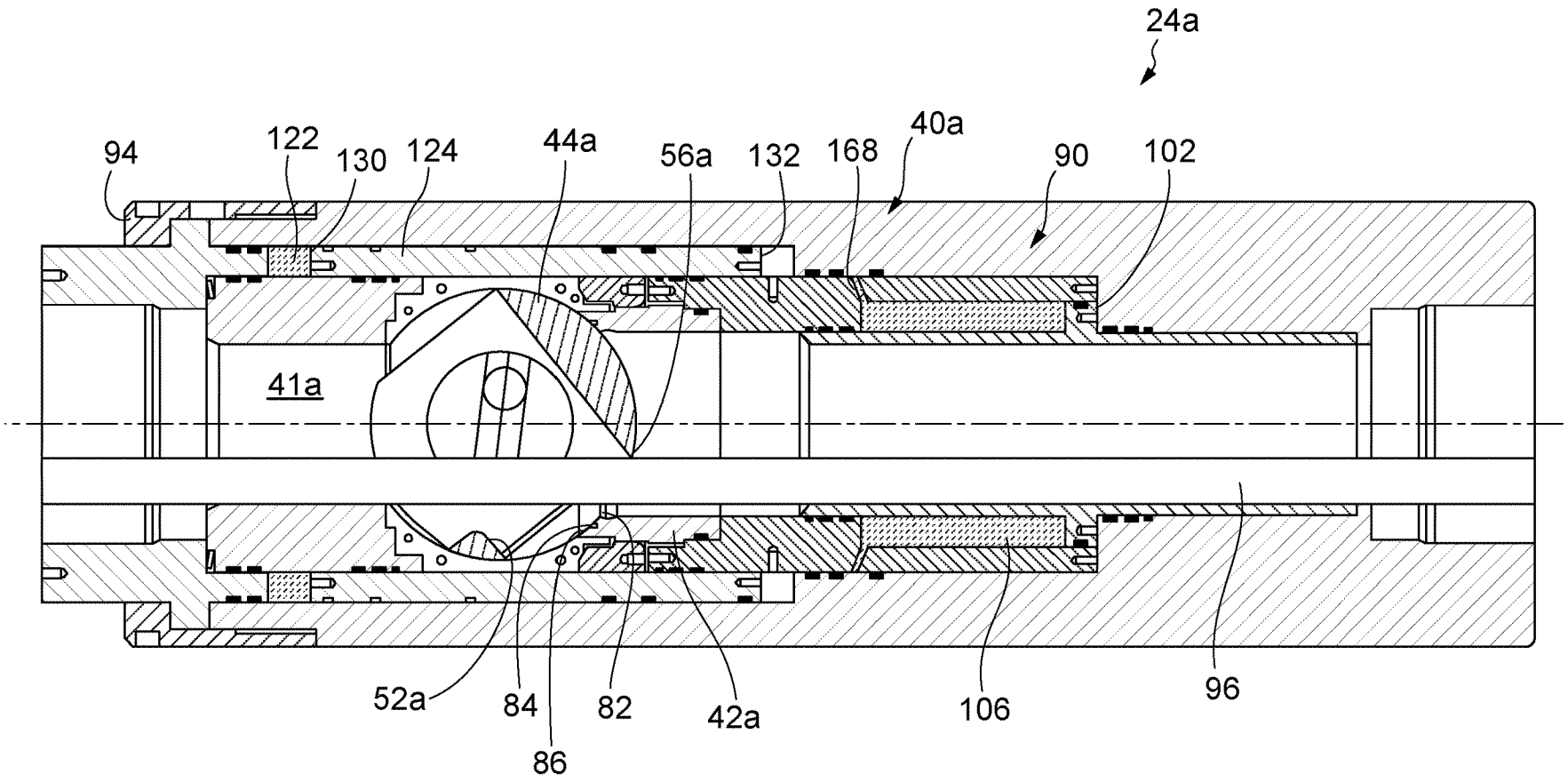
FIG. 9 is a view of the valve assembly of FIG. 3 showing the valve member part way between its movement from the open to the closed position, with the seal element in the first position, during cutting of a body located in a bore of a housing of the valve assembly.

As described above, during use of the valve assembly 24*a* of the invention, a body such as coiled tubing may be deployed through the bore 41*a* of the valve assembly. FIG. 9 is a view which is similar to FIG. 3 and which shows a coiled tubing 96 extending along the housing bore 41*a*. In the illustrated example, a situation has arisen in which it has become necessary to close the valve assembly 24*a*, by actuating the assembly to rotate the valve member 44*a* from its open position of FIG. 3 to its closed position of FIG. 4. FIG. 9 shows the valve member 44*a* during this movement, which has caused the coiled tubing 96 extending along the housing bore 41*a* to be moved from a position in which it is disposed towards a center of the bore, to a position in which it is adjacent a side of the bore proximate the cutting surface 82. This has been achieved by contact with the leading edge surface 56*a* of the ball valve member 44*a* as it rotates.

Continued movement of the valve member 44*a* towards its closed position causes the coiled tubing 96 to be severed by cooperation between the leading edge surface 56*a* of the valve member and the cutting surface 82 in the housing 40*a*. Severing is achieved in a scissors-type shearing procedure, in which the leading edge surface 56*a* overlaps the cutting surface 82, in a fashion which is known in the art. The portion of the coiled tubing 96 disposed above (uphole) of the valve member 44*a* can then be recovered to surface. The remaining portion of the coiled tubing 96, and any equipment connected to it, drops into the well and can subsequently be recovered, for example in a fishing operation.

The valve seat 42*a* is located within the housing 40*a*. As is well known in the industry, following closure of the valve member 44*a*, fluid pressure acting on the valve member from below (downhole) may act to urge the sealing surface 80 on the valve member 44*a* into sealing contact with the first seal element 84 carried by the seat 42*a*. However, the valve seat 42*a* is suitably biased into sealing contact with the valve member 44*a*, for example via a compression spring 99, which may take the form of a disc spring such as a Belleville spring/washer.

The second seal element 88 comprises a sealing surface 98 which provides the second seal with the sealing surface 80 of the valve member 44*a*. The sealing surface 98 is provided on, near or adjacent an end 100 of the second seal element 88 which faces towards the valve member 44*a*. The second seal element 88 is provided as a generally tubular sleeve which is mounted for translational movement relative to the housing bore 41*a* between its first and second positions of FIGS. 3 and 5. The sealing surface 98 may simply be provided by the end 100 of the second seal element 88, and so of the material forming the seal element, the valve member 44*a* and second seal element 88 typically being of a metal/metal alloy, and so a metal-to-metal seal being provided. However, a dedicated sealing material, e.g. of a softer (more malleable) metal/metal alloy, or of an elastomeric material, may provide the sealing surface 98.

The second seal element 88 is hydraulically actuated for movement between its first and second positions. To this end, the second seal element 88 comprises a piston, which is provided as a generally annular shoulder 102 extending from an outer surface 104 of the sleeve forming the second seal element. A cylinder is defined within the housing 40*a*, the cylinder indicated generally by reference numeral 106. In the illustrated embodiment, the cylinder 106 is formed by the valve seat 42*a*, a tubular component 108 forming part of the housing 40*a*, and the sleeve forming the second seal element 88. Specifically, the cylinder 106 is defined by a radially extending surface 110 of the valve seat 42*a*, an axially extending surface 112 of the valve seat, the outer surface 104 of the sleeve forming the second seal element 88, and a shoulder 114 defined by the tubular housing component 108. The piston 102 comprises a first piston face 116 and a second, opposed piston face 118. As will be described in more detail below, hydraulic fluid is supplied to and exhausted from the cylinder 106 to act upon the first and second piston faces 116 and 118, in order to translate the piston 102, and so the second seal element 88, between its first and second positions.

The valve assembly 24*a* is arranged so that movement of the second seal element 88 from its first position of FIG. 3 towards its second position of FIG. 5 is only triggered following commencement of movement of the valve member 44*a* towards its closed position. Specifically, the valve assembly 24*a* is arranged so that movement of the second seal element 88 from its first position to its second position is only triggered following movement of the valve member 44*a* to a position in which the second seal element 88 is shielded from contact with the cutting feature of the valve member, and cannot contact the cutting feature. This is best shown in FIG. 6, which shows the valve member 44*a* following movement through a majority of its rotation from the open to the closed position. As can be seen, the seal element 88 has not yet been moved away from the its first position, and the valve member 44*a* has been rotated to a position in which its cutting edge surface 56*a* is generally transverse to a direction of movement of the seal element 88, and proximate to the cutting surface 82 in the housing 40*a*. In this position of the valve member 44*a*, the valve member itself, in particular its sealing surface 80, shields the second seal element 88 from contacting the cutting edge surface 56*a*, reducing a likelihood of damage to its sealing surface 98. The valve assembly 24*a* may therefore be arranged so that movement of the second seal element 88 from its first position to its second position is only triggered following movement of the valve member 44*a* to a position in which its cutting feature is proximate the cutting surface 82.

In a conventional fashion, the cutting edge surface 56*a* and the cutting surface 82 are typically arranged to cooperate to cut a body extending through the housing bore 41*a* (e.g. coiled tubing 96) in an overlapping scissors-type cutting or shearing action. The valve assembly 24*a* may be arranged so that movement of the second seal element 88 from its first position to its second position is only triggered following movement of the valve member 44*a* to a position in which the cutting edge surface 56*a* overlaps the cutting surface 82. In one option, the valve assembly 24*a* may be arranged so that movement of the second seal element 88 from its first position to its second position is only triggered following location of the valve member 44*a* in its closed position of FIG. 4. This may therefore require completion of a movement of the valve member 44*a* to its closed position before movement of the second seal element 88 is triggered.

The valve assembly 24*a* is also arranged so that movement of the valve member 44*a* from its closed position of FIG. 4 towards its open position of FIG. 3 is only triggered when the second seal element 88 is moved from its second position towards its first position. The valve assembly 24*a* may be arranged so that movement of the valve member 44*a* from its closed position towards its open position is only triggered following movement of the second seal element 88 away from its second position, in particular following movement of the second seal element to a position in which it is out of sealing contact with the valve member. The valve assembly 24*a* may be arranged so that movement of the valve member 44*a* from its closed position to its open position is only triggered after the second seal element 88 has moved a majority of a distance from its second position towards its first position, and optionally in which the second seal element is proximate an end of its travel to the first position. Optionally, the valve assembly 24*a* is arranged so that movement of the valve member 44*a* from its closed position to its open position is only triggered following location of the second seal element 88 in its first position. This may require completion of a movement of the second seal element 88 to its first position before movement of the valve member 44*a* is triggered.

This may again reduce a likelihood of the cutting edge surface 56*a* of the valve member 44*a* contacting the second seal element, in particular its sealing surface 98. It may also provide the advantage that contact between the second seal element 88 and the valve member 44*a*, specifically between their sealing surfaces 98 and 80, may be reduced during movement of the valve member between its closed and open positions.

Such control of the operation of the valve member 44*a* and the second seal element 88 may be achieved employing the control assembly 90 mentioned above. The control assembly 90 may control movement of the valve member 44*a* between its open and closed positions, and movement of the second seal element 88 between its first and second positions. The control assembly 90 may be arranged or configured to sequence the movements of the valve member 44*a* and the second seal element 88 in order to achieve the objectives discussed above.

To this end, the control assembly 90 comprises a control valve 120 which controls the supply of fluid to the second seal element 88, to move from its first position to its second position. In the illustrated embodiment, the control valve 120 is provided by an annular piston 124, which is moveable within a cylinder 122 defined by the housing 40*a*. In the illustrated embodiment, the piston 124 has a primary function of translating a cage (not shown) coupled to the valve member 44*a*, via trunnions 126, to rotate the valve member between its different positions.

Figure 6:
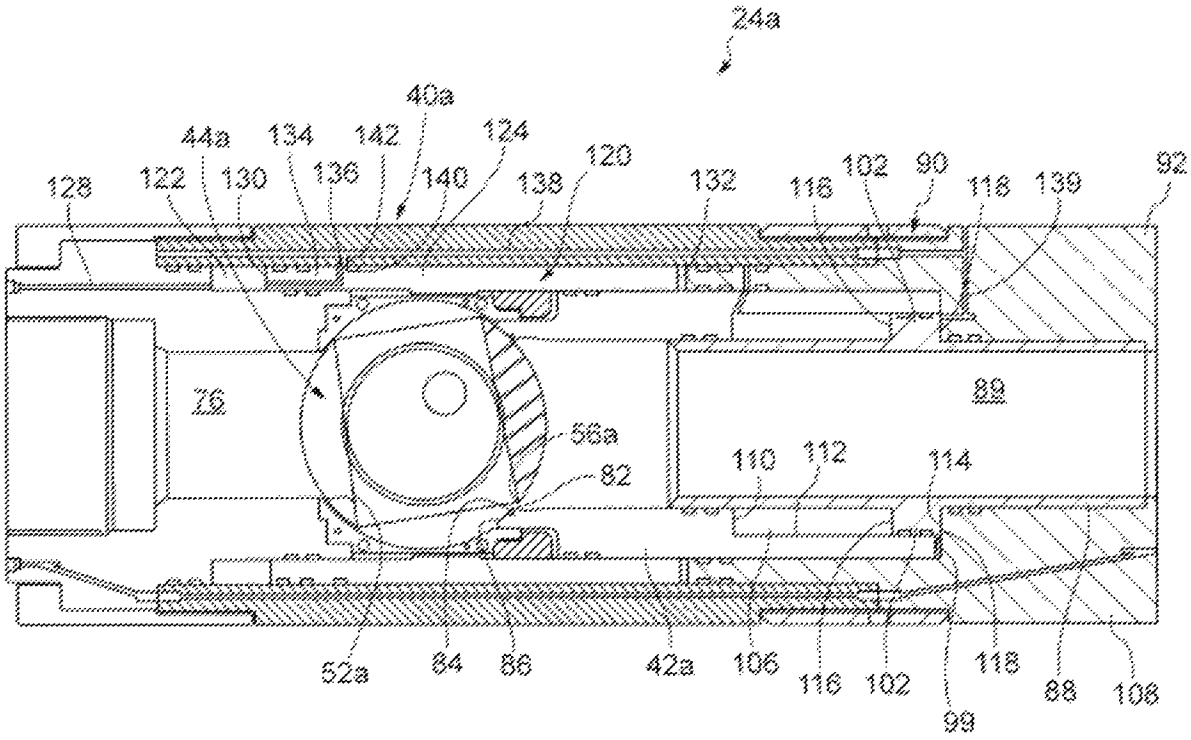
FIG. 6 is a view of the valve assembly of FIG. 3 showing the valve member part way between its movement from the open to the closed position, and with the seal element in the first position.

When it is desired to move the valve member 44*a* from its open position to its closed position, hydraulic fluid is supplied to the valve assembly 24*a* via a hydraulic fluid line 128, which is shown in FIGS. 5 and 6. The hydraulic fluid is supplied into the cylinder 122, and acts upon a first face 130 of the piston 124. At the same time, fluid contained in a portion of the cylinder 122 in communication with a second face 132 of the piston 124 is allowed to exhaust from the cylinder. A net pressure force is therefore imparted upon the piston 124, which acts to move it from the position of FIG. 3, through the partially closed position of FIG. 6, to the fully closed position of FIG. 4. During this movement, the connection between the cage of the valve member 44*a* and the piston 124, through the trunnions 126, acts to rotate the valve member to its closed position.

During initial movement of the valve member 44*a* from its open position towards its closed position, the second seal element 88 is secured against movement from its first position towards its second position (in which it contacts the valve member). The control valve 120 includes a flow passage 134, which is defined by the piston 124. The flow passage 134 includes a flow port 136 which can selectively communicate with a communication passage 138 associated with the second seal element 88. A seal 140 is carried by the piston 124, and is arranged relative to the flow port 136 so that it prevents communication between the flow port 136, and a branch 142 of the communication passage 138, until such time as the piston 124 is near the end of its travel (as shown in FIG. 6), optionally in which it has reached the complete end of its travel (as shown in FIG. 5). In this way, commencement of movement of the second seal element 88 from its first position of FIG. 3 towards its second position of FIG. 5 (in which it contacts the valve member 44*a*) is only commenced when the valve member 44*a* is very close to having completed its movement, or has completed its movement to the closed position. This shields the second seal element 88 from contact with the valve member cutting edge surface 56*a*, as discussed above.

When the piston 124 has moved to a position in which the flow port 136 can communicate with the branch 142, hydraulic fluid is supplied through the fluid line 128 and into the communication passage 138. This serves to supply hydraulic fluid into the second seal element cylinder 106, via a branch 139, acting on the second face 118 of the second seal element piston 102, acting to translate it from the first position of FIG. 3 towards the second position of FIG. 5. During this movement, hydraulic fluid is exhausted from the portion of the cylinder 106 which communicates with the first piston face 116.

The control assembly 90 also comprises a control valve for controlling the supply of fluid to the valve member 44*a* to move it from the closed position of FIG. 5 to the open position of FIG. 3. The control valve is indicated generally by reference numeral 144 in the drawing, and is best shown in the enlarged views of FIGS. 7 and 8. As will be described, the control valve 144 controls the supply of fluid to the valve member 44*a*, specifically the piston 124, to move the valve member 44*a* from the closed position to the open position.

The control valve 144 comprises a valve element in the form of a ported poppet 146, which is located in the housing component 108. The control valve 144 is biased towards a closed position (FIG. 7) in which fluid flow to the valve member 44*a*, to move it to its open position, is prevented. Biasing of the valve element 146 is suitably achieved using a spring in the form of a compression spring 148, although other arrangements including a torsion spring or electromechanical actuator (such as a solenoid) could be employed. The valve element 146 includes a port 147 extending along its length, to prevent hydraulic lock.

The valve element 146 cooperates with the second seal element 88 to move to an open position, shown in FIG. 8, in which fluid flow to the valve member 44*a* is permitted, to in-turn move the valve member 44*a* to its open position. The valve element 146 has an end 150 which, in the closed position, protrudes through an opening 152 of the housing component 108 and into the second seal element cylinder 106. The end 150 of the valve element 146 is contacted by the second face 118 of the second seal element piston 102 when it moves into its first position of FIG. 3. This causes an enlarged dimension sealing portion 154 of the valve element 146 to move out of sealing contact with a seal seat 156, opening up communication between ports 158 and 160 of the control valve 144. The port 158 communicates with a flow passage 162 extending from the valve member cylinder 122, whilst the port 160 communicates with a communication passage 164 via a branch 166. The communication passage 164 is shown in the drawings in a similar position to the flow passage 138 of FIGS. 5 and 6. However, it will be understood that this is for illustration purposes only, and that the communication passage 164 is actually spaced around a circumference of the housing 40*a* from the flow passage 138.

When the valve member piston 124 is actuated to move from its position of FIG. 3 (in which the valve member 44*a* is open) to the position of FIG. 4 (in which the valve member 44*a* is closed), fluid which is exhausted from the cylinder 122 passes along the flow passage 162 and through the control valve port 158. This fluid then flows through the valve 144, along an annular space defined between the seal seat 156 and the enlarged portion 154, exiting the valve 144 through the port 160. The fluid then flows along the branch 166 into the flow passage 162, and then to the valve member cylinder 122, where it acts upon the face 132 of the valve member piston 124, to urge it to the position shown in FIG. 3 (carrying the valve member 44*a* to its open position).

As can be seen by comparing FIG. 6 (which shows the valve member 44*a* part-way towards its movement to the closed position) with FIG. 4 (which shows the valve member 44*a* in its closed position), the second seal element 88 is initially held in its first position, away from the valve member 44*a*. The way in which this is achieved can be appreciated particularly from reviewing FIG. 3. As can be seen here, the communication passage 164 communicates with the cylinder 106 of the second seal element 88 via a branch 168. Accordingly, at the time when the valve element 146 of the control valve 144 is held in its open position (FIG. 8), fluid which is supplied through the valve (via the ports 158 and 160) and into the communication passage 164 (via the branch 166) can communicate with the cylinder 106, through the branch 168. This fluid acts upon the first face 116 of the second seal element piston 102, urging it towards its first position of FIG. 3.

Movement of the valve member 44*a* from its closed position to its open position is achieved as follows. As shown in FIG. 5, in the closed position, hydraulic fluid has been supplied into the cylinder 122 via hydraulic fluid line 128, and communicated to the cylinder 106 of the second seal element 88 via the communication passage 138 and branch 139. This acts to urge the second seal element sealing surface 98 against the sealing surface 80 of the valve member 44*a*.

When it is desired to return the valve member 44*a* to the open position, hydraulic pressure applied to the hydraulic line 128 is bled off, and fluid supplied into a hydraulic line 170 which communicates with the communication passage 164. It will be noted that, at this time, the piston 102 of the second seal element 88 is in its second position, and so that the valve element of the control valve 144 has been allowed to move to its closed position of FIG. 7, under the force of the biasing spring 148. This has the effect of maintaining the valve member piston 124 in the position shown in FIG. 5, as the flow port 158 of the control valve 144 is closed. There is therefore effectively a hydraulic lock maintaining the valve element 44*a* in its closed position.

The fluid supplied into the communication passage 164 by the hydraulic line 170 is directed into the cylinder 106 of the second seal element 88 via the branch 168, and acts upon the first piston face 166. This urges the piston 102 away from the position of FIG. 5 and towards the position of FIG. 3, FIG. 4 showing the piston at a location which is between the two extremes of its movement. Fluid contained within the cylinder 106 which is in communication with the second piston face 118 is exhausted from the cylinder through the branch 139 and the communication passage 138, exiting the valve assembly 28*a* via the hydraulic fluid line 128.

When the piston 102 reaches the end of the cylinder 106 and contacts the end 150 of the control valve element 146, the control valve 144 is moved to its open position of FIG. 8. The hydraulic pressure supplied to the valve assembly 24*a* via the hydraulic line 170 can then be communicated to the cylinder 122, via the flow passage 162. This fluid acts upon the second face 132 of the piston 124, urging it towards the position shown in FIG. 3, carrying the ball member 44*a* and so rotating it to its open position. Fluid contained within the portion of the cylinder 122 in communication with the first face 130 of the piston 124 is then exhausted from the cylinder through the hydraulic line 128.

It will be understood that modifications can be made to the control assembly 90 in order to provide variations on the precise sequencing of the operation of the valve member 44*a* and the second seal element 88. For example, by varying a position of the seal 140 on the valve member piston 124, flow port 136 and/or of the branch 142, the second seal element 88 can be arranged so that it only moves to the second position (in sealing contact with the valve member) when the valve member has completed its movement to the closed position. By varying the way in which the control valve 140 operates, the valve member 44*a* can be arranged so that it only moves from its closed position to its open position after the second seal element has completed its movement to its first position.

The second seal element 88 is typically located inwardly of the first seal element 84, specifically radially inwardly of the valve seat 42*a* carrying the first seal element 84. This may facilitate assembly and maintenance of the valve assembly 24*a*. The valve member 44*a* comprises a bore 52*a* which describes a minimum internal dimension, which in the illustrated embodiment is a diameter $d_1$. The second seal element 88 comprises a bore 89, which is substantially aligned with the housing bore 41*a*. The second seal element bore 89 describes a minimum internal dimension, which in the illustrated embodiment is a diameter $d_2$. The minimum internal diameter $d_2$ described by the second seal element bore 89 is substantially the same as, and optionally greater than, the minimum internal dimension $d_1$ described by the valve member bore 52*a*. This may provide the advantage of reducing a likelihood of the end of the second seal element 88 defining the sealing surface 98 contacting a body being passed through the housing bore 41*a*.

The present invention may provide an effective dual seal barrier and hydraulic system for operating a moveable seal element to engage a valve member. The valve assembly may be operable multiple times for movement between open and closed positions, with an effective seal being provided. The first seal element (which may be optional) may provide a seal in both open and closed positions of the valve member, and indeed during movement of the valve member between those positions. The second seal element may only be moved into sealing contact with the valve member when the valve member is moved towards its closed position. The valve member may only be moved from its closed position towards its open position when the second seal element has been moved out of sealing contact with the valve member.

Various modifications may be made to the foregoing without departing from the spirit or scope of the present invention.

The control assembly may comprise an actuator for controlling at least one of the movements a) and b) set out above. The actuator may be associated with or may define one or more control valves for controlling at least one of said movements, and may be operable to open and close said control valve(s). The actuator may be operable to cause at least one of said movements on receipt of a control signal. Receipt of a control signal by the actuator may cause the actuator to open a fluid communication path and/or to supply fluid to the selected one or more of the valve member and the second seal element (suitably by controlling said valve or valves), to cause the desired movement. The actuator may be an electro-mechanical actuator such as a solenoid. The control signal may then be an electrical control signal. The actuator may be a pressure switch, such as a roller or plunger type pressure switch. The control signal may then be a pressure signal. The control signal may be issued from surface to the valve assembly, for example via a control line (electrical or hydraulic); via a fluid pressure signal, acoustic signal, radio or other frequency signal, which may be transmitted through a column of fluid in tubing or a wellbore in which the valve assembly is deployed, or through tubing coupled to the valve assembly, as appropriate. The valve assembly may comprise a controller associated with the control assembly, which may receive the control signal and issue a command signal to the actuator to operate the actuator.

The invention claimed is:

1. A valve assembly comprising:

a housing having a bore;

a valve member arranged within the housing, the valve member being movable relative to the housing bore between an open position in which communication along the bore is permitted, and a closed position in which communication along the bore is restricted, the valve member comprising a cutting feature and a sealing surface;

a cutting component arranged within the housing, the cutting component cooperating with the cutting feature of the valve member when the valve member is moved to the closed position;

a first seal element arranged within the housing, the first seal element providing a first seal relative to the sealing surface of the valve member, to seal the valve member relative to the housing; and a second seal element arranged within the housing, the second seal element providing a second seal relative to the sealing surface of the valve member, to seal the valve member relative to the housing, the second seal element being movable relative to the housing bore between a first position in which it is out of sealing contact with the sealing surface of the valve member and a second position in which it is in sealing contact with the sealing surface of the valve member; and wherein the valve assembly is arranged so that movement of the valve member from its closed position towards its open position is only triggered following movement of the second seal element away from its first position.

2. The valve assembly of claim 1, in which the second seal element is movable between its positions by the application of fluid pressure.

3. The valve assembly of claim 2, in which the second seal element comprises a piston and the housing defines at least part of a cylinder within which the piston is mounted.

4. The valve assembly of claim 1, in which the valve assembly is arranged so that movement of the second seal element from its first position to its second position is only triggered following commencement of movement of the valve member towards its closed position.

5. The valve assembly of claim 4, in which the valve assembly is arranged so that movement of the second seal element from its first position to its second position is only triggered following movement of the valve member to a position in which the second seal element is shielded from contact with the cutting feature of the valve member.

6. The valve assembly of claim 4, in which the valve assembly is arranged so that movement of the second seal element from its first position to its second position is only triggered following movement of the valve member to a position in which its cutting feature is proximate the cutting component.

7. The valve assembly of claim 4, in which the cutting feature and the cutting component cooperate to cut a body extending through the housing bore in an overlapping scissors-type cutting action, and in which the valve assembly is arranged so that movement of the second seal element from its first position to its second position is only triggered following movement of the valve member to a position in which the cutting feature overlaps the cutting component.

8. The valve assembly of claim 4, in which the valve assembly is arranged so that movement of the second seal element from its first position to its second position is only triggered following location of the valve member in its closed position.

9. The valve assembly of claim 1, in which the valve assembly is arranged so that the valve member is moved from its closed position towards its open position when the second seal element is moved from its second position towards its first position.

10. The valve assembly of claim 9, in which the valve assembly is arranged so that movement of the valve member from its closed position towards its open position is only triggered after the second seal element has moved a majority of a distance from its second position towards its first position.

11. The valve assembly of claim 9, in which the valve assembly is arranged so that movement of the valve member from its closed position towards its open position is only triggered following location of the second seal element in its first position.

12. The valve assembly of claim 1, comprising a control assembly for controlling at least one of:

a) movement of the valve member between its open and closed positions; and b) movement of the second seal element between its first and second positions.

13. The valve assembly of claim 12, in which the control assembly is arranged:

to control the supply of fluid to and from a piston associated with the valve member, movement of the piston causing the valve member to move between its open and closed positions; and to control the supply of fluid to and from the second seal element, to move it between its open and closed positions.

14. The valve assembly of claim 12, in which the control assembly comprises a seal control valve for controlling the supply of fluid to the second seal element, to move it from its first position to its second position;

wherein the valve assembly comprises a piston associated with the valve member, movement of the piston causing the valve member to move between its open and closed positions, and the seal control valve is associated with the valve member piston, the control valve comprising a flow passage having a flow port which can communicate with an inlet port of a communication passage associated with the second seal element, when the piston is operated to move the valve member towards its closed position; and wherein the valve member piston comprises a seal which is arranged to isolate the flow port from the inlet port of the communication passage, movement of the valve member piston towards a position in which the valve member is in its closed position causing fluid communication between the flow port and the inlet port of the communication passage to be opened.

15. The valve assembly of claim 12, in which the control assembly comprises a valve member control valve for controlling the supply of fluid to the valve member to move it from the closed position to the open position.

16. The valve assembly of claim 1, in which the first seal element provides a first seal relative to the sealing surface of the valve member when the valve member is in its closed position and when the valve member is in its open position.

17. The valve assembly of claim 1, in which the cutting component cooperates with the cutting feature of the valve member when the valve member is moved to the closed position, to cut a body extending along the bore of the housing.

18. A method of controlling communication along a bore of a housing, the method comprising the steps of:

locating a valve member within the housing, the valve member comprising a cutting feature and a sealing surface;

arranging the valve member so that it is movable relative to the housing bore between an open position in which communication along the bore is permitted, and a closed position in which communication along the bore is restricted;

locating a cutting component within the housing;

operating the valve member to move to its closed position, movement of the valve member to the closed position facilitating cooperation between the cutting component and the cutting feature of the valve member;

locating a first seal element within the housing, and arranging the first seal element so that it provides a first seal relative to the sealing surface of the valve member, to seal the valve member relative to the housing;

locating a second seal element within the housing, and arranging the second seal element so that it provides a second seal relative to the sealing surface of the valve member; and moving the second seal element relative to the housing bore between a first position in which it is out of sealing contact with the sealing surface of the valve member, and a second position in which it is in sealing contact with the sealing surface of the valve member, when the valve member is in its closed position, to seal the valve member relative to the housing; and wherein movement of the valve member from its closed position towards its open position is only triggered following movement of the second seal element away from its first position.

19. A valve assembly comprising:

a housing having a bore;

a valve member arranged within the housing, the valve member being movable relative to the housing bore between an open position in which communication along the bore is permitted, and a closed position in which communication along the bore is restricted, the valve member comprising a cutting feature and a sealing surface;

a cutting component arranged within the housing, the cutting component cooperating with the cutting feature of the valve member when the valve member is moved to the closed position; and a seal element arranged within the housing, the seal element providing a seal relative to the sealing surface of the valve member, to seal the valve member relative to the housing, the seal element being movable relative to the housing bore between a first position in which it is out of sealing contact with the sealing surface of the valve member and a second position in which it is in sealing contact with the sealing surface of the valve member, the seal element being movable between the first and second positions by the application of fluid pressure; and wherein the valve assembly is arranged so that movement of the valve member from its closed position towards its open position is only triggered following movement of the seal element away from its first position.

* * * * *